US007094159B2

(12) United States Patent
Takeda

(10) Patent No.: US 7,094,159 B2
(45) Date of Patent: Aug. 22, 2006

(54) GOLF CLUB AND METHOD FOR MANUFACTURING THE SAME

(75) Inventor: Hitoshi Takeda, Niigata-ken (JP)

(73) Assignee: K.K. Endo Seisakusho, (JP)

( * ) Notice: Subject to any disclaimer, the term of this patent is extended or adjusted under 35 U.S.C. 154(b) by 88 days.

(21) Appl. No.: 10/919,096

(22) Filed: Aug. 16, 2004

(65) Prior Publication Data

US 2005/0043116 A1 Feb. 24, 2005

(30) Foreign Application Priority Data

Aug. 18, 2003 (JP) ..... 2003-294663

(51) Int. Cl.
*A63B 53/04* (2006.01)

(52) U.S. Cl. ..... 473/345; 473/349

(58) Field of Classification Search ..... None
See application file for complete search history.

(56) References Cited

U.S. PATENT DOCUMENTS 6,364,789 B1 * 4/2002 Kosmatka ..... 473/329
6,565,452 B1 * 5/2003 Helmstetter et al. ..... 473/342
6,955,612 B1 * 10/2005 Lu ..... 473/324
6,969,326 B1 * 11/2005 De Shiell et al. ..... 473/345
2005/0026723 A1 * 2/2005 Kumamoto ..... 473/345

FOREIGN PATENT DOCUMENTS

JP 2002165902 A * 6/2002
JP 2003-205055 7/2003
JP 2004159854 A * 6/2004

* cited by examiner

*Primary Examiner*—Eugene Kim
*Assistant Examiner*—Alvin A. Hunter, Jr.
(74) *Attorney, Agent, or Firm*—Akerman Senterfitt

(57) ABSTRACT

The partial crown portion member comprises: the edge frame made from metal; the shell body made from metal and provided inwardly of the edge frame; the joining member made from resin and provided in between the inner edge of the edge frame and the edge of the shell body so as to envelop the inner edge of the edge frame and the edge of the shell body. The inner edge of the edge frame is formed with the first through-hole, while the edge of the shell body is formed with the second through-hole. The joint member made from resin envelops the portion where the inner edge of the edge frame and the edge of the shell body by casting manner. Accordingly, the edge frame and the shell body made from different kinds of metals can be strongly joined.

4 Claims, 3 Drawing Sheets

GOLF CLUB AND METHOD FOR MANUFACTURING THE SAME

BACKGROUND OF THE INVENTION

1. Field of the Invention

The present invention relates to a golf club and a method for manufacturing the same.

2. Description of the Related Art

As conventional known techniques of joining a metallic shell and a fiber-reinforced-plastic-made shell in order to form a head body employing a hollow structure, Japanese Unexamined Patent Publication No. 2003-205055 discloses ones that: bonding a joining portion of the fiber-reinforced-plastic-made shell to both surfaces of a joining portion of the metallic shell; or forming a through-hole on the joining portion of the metallic shell so as to obtain joining strength of the metallic shell relative to the fiber-reinforced-plastic-made shell.

According to those conventional techniques, the golf club head can be lightened by the fiber-reinforced-plastic-made shell. In this golf club head, however, there is a limitation of enhancing its strength even the fiber-reinforced-plastic-made shell is used.

As a technique to solve this problem, one can be considered that forming the golf club head by combining a plurality of metals, each metal having small specific weight and different strength. According to this technique, for example, pure titanium/titanium alloy and magnesium alloy each having small specific gravity are used. Pure titanium/titanium alloy is used for a portion of the golf club head where larger durability and strength are required, while magnesium ally is used for a portion of the golf club head where smaller durability and strength are required.

However, welding the different kinds of metals in order to join them is difficult. Moreover, large adhesion can not be obtained when the different kinds of metals are joined by bonding as the above-described conventional techniques, or even an opening are provided thereon for bonding. Accordingly, sufficient joining strength of the different kinds of metals can not be obtained.

SUMMARY OF THE INVENTION

The present invention has been made to solve the above problems. It is, accordingly, an object of the present invention to enhance joining strength of a frame member and a shell body in a golf club head which includes: the frame member made from a metallic material; and the shell body made from a material such as a metal having smaller specific gravity than that of the frame member and provided inwardly of the frame member.

In order to attain the above object, according to a first aspect of the present invention, there is provided a golf club comprising: a golf club head formed by a shell member so as to be hollow; and a shaft connected to the golf club head, wherein the shell member comprises: a frame member made from a metallic material; a shell body made from a material, the material having smaller specific gravity than the material of the frame member; and a joint member made from resin, the joint member being provided in between an inner edge of the frame member and an edge of the shell body so as to envelop the inner edge of the frame member and the edge of the shell body by casting manner.

By employing the above-described structure, the edge of the frame member and the edge of the shell body are enveloped with the molten resin by casting manner. Accordingly, the frame member and the shell body made from different kinds of metals can be strongly joined.

Alternatively, in the above-described golf club, the inner edge of the frame member and the edge of the shell body may be laid on top of another; a first through-hole may be provided on the inner edge of the frame member so as to pierce a front surface of the inner edge to a rear surface thereof; a second through-hole may be provided on the edge of the shell body so as to pierce a front surface of the edge to a rear surface thereof; the joint member may envelop a portion where the inner edge of the frame member and the edge of the shell body are laid on top of another, while the joint member being filled in the first through-hole and the second through-hole.

Moreover, the first through-hole and the second through-hole may be arranged equiaxially relative to each other.

In order to attain the above object, according to a second aspect of the present invention there is provided a method for forming a golf club, the golf club comprising a golf club head and a shaft connected to the golf club head, the golf club head being formed by a plurality of partial shell members so as to be hollow, at least one of the partial shell members including a frame member made from a metallic material and a shell body made from metal, the shell body being provided inwardly of the frame member, the method comprising the steps of: inserting the frame member into a die; inserting the shell body into an inside of the frame member in the die; closing the die with an other die; filling a molten resin in between an inner edge of the frame member and an edge of the shell body; and enveloping the inner edge of the frame member and the edge of the shell body with the molten resin by casting manner so as to join the inner edge of the frame member and the edge of the shell body.

According to the above-described method, adhesion of the edge of the frame member and the edge of the shell body can be enhanced by a pressure for filling the molten resin. Moreover, the frame member and the shell body made from different kinds of metals can be strongly joined by enveloping their edges by casting manner.

Alternatively, the above-described method may further comprise the steps of: forming a first through-hole on the edge of the frame member, the first through-hole piercing front and rear surfaces thereof; forming a second through-hole on the edge of the shell body, the second through-hole piercing front and rear surfaces thereof; allowing the inner edge of the frame member and the edge of the shell body to be laid on top of another upon inserting the frame member and the shell body into the dies; and arranging the first through-hole and the second through-hole equiaxially relative to each other upon inserting the frame member and the shell body into the dies.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Figure 1:
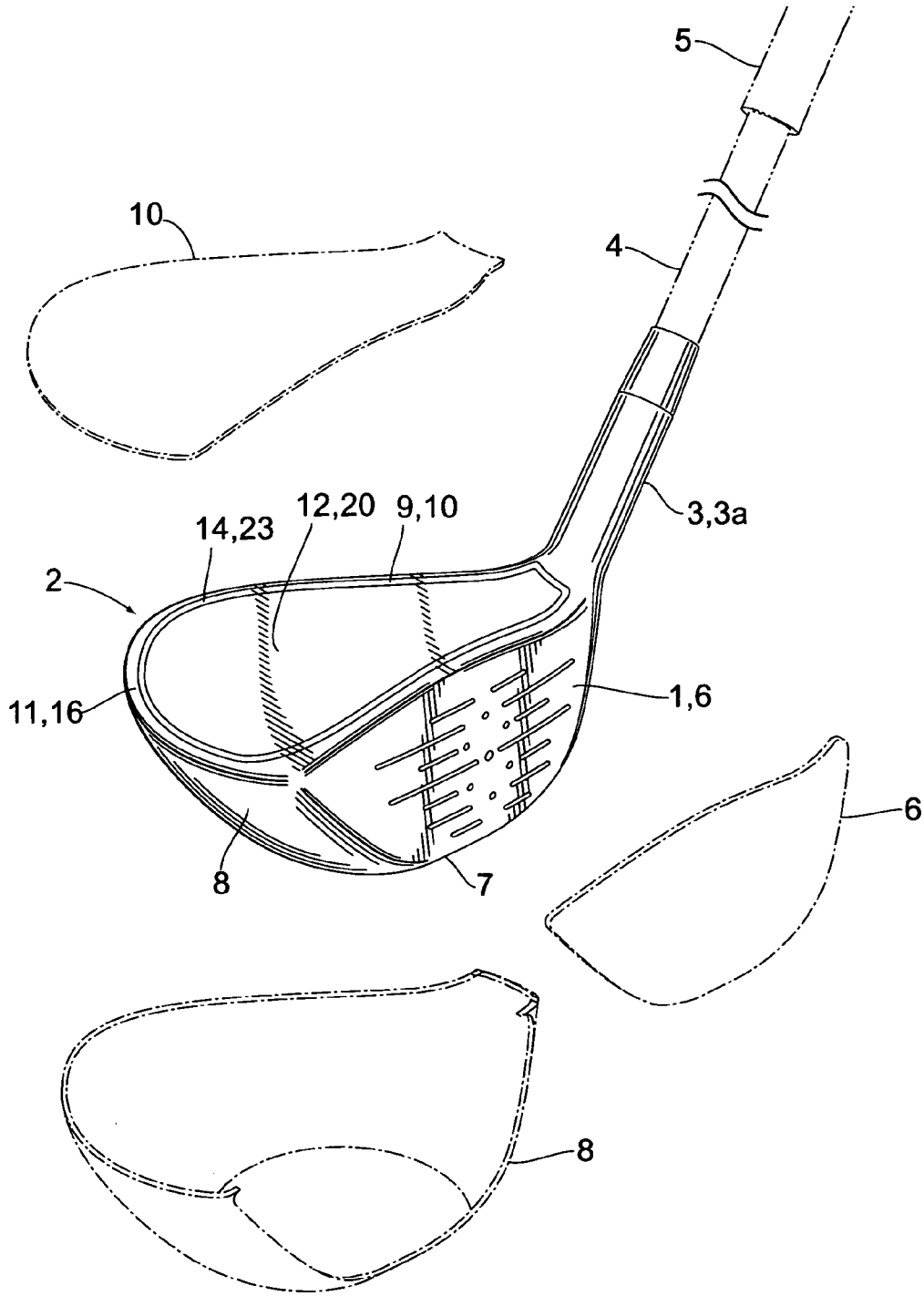
FIG. 1 is a perspective view showing a golf club according to a preferred embodiment of the present invention.
Figure 2:
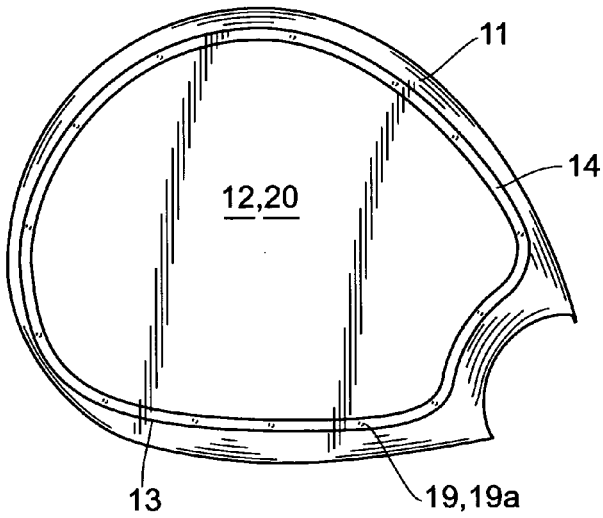
FIG. 2 is a top plan view showing a partial crown portion member included in a golf club head according to the preferred embodiment.
Figure 3:
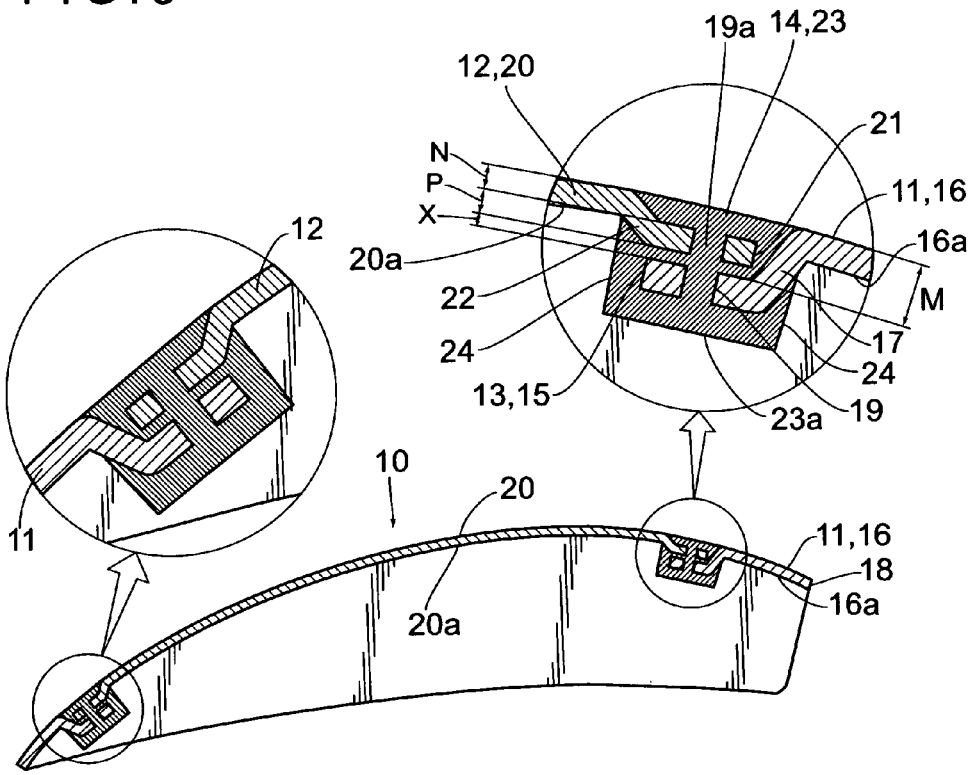
FIG. 3 is a cross sectional view showing the partial crown portion member according to the preferred embodiment.

Preferred embodiment of the present invention will now be described in detail with reference to the accompanying drawings.

FIGS. 1 through 4 show a wood type golf club head according to this embodiment of the present invention. This wood type golf club comprises: a golf club head (hereinafter, "head") 2 having a face 1 on its front; a shaft 4 (shown by chain double dashed lines) having a bottom end connected to a neck 3 formed on one side of the head 2; and a grip 5 provided on an upper portion of the shaft 4. As shown by chain lines in the figures, the head 2 employs a hollow structure formed by joining a plurality of partial shell members so as to include: a partial face portion member 6 forming the face 1; a partial sole-peripheral side surface portion member 8 forming a sole 7, right, left and rear portions of the head 2; a partial crown portion member 10 forming a crown 9; and a neck member (not shown) formed in a cylindrical shape protruding from the one side of the head 2 so as to form the neck 3. Each edge, etc. of the plurality of partial shell members is joined by welding such as laser welding so as to be integrated one another.

Both of the partial face portion member 6 and the partial sole-peripheral side surface portion member 8 comprise processed metal plates made from pure titanium, titanium alloy or the like. The partial crown portion member 10 comprises: an edge frame 11 as a metal frame made from pure titanium or titanium alloy; and a shell body 12 made from a metal such as magnesium alloy having smaller specific gravity than that of the edge frame 11. The shell body 12 is formed in a plate shape and provided inwardly of the edge frame 11. The edge frame 11 forms an edge of the crown 9. The shell body 12 is placed on a window opening 13 surrounded by the edge frame 11 via a joining member 14 made from resin (plastic).

The edge frame 11 having the window opening 13 inwardly comprises a metal plate of an approximately uniform thickness which is processed by pressing or the like. A front surface 16 of an inner edge 15 of the edge frame 11 is arranged downwardly relative to the front surface 16 of an edge 18 thereof and provided sideways via a first step portion 17 concaving downwardly. The inner edge 15 is formed with a through-hole 19 piercing the front surface 16 and a rear surface 16*a* in an upper-to-bottom direction along the inner edge 15. The joining member 14 is one for arranging a front surface 20 of the shell body 12 covering the window opening 13 in the same plane as the front surface 16 of the edge frame 11. An edge 21 of the shell body 12 is provided so as to be laid on the inner edge 15 of the edge frame 11. The shell body 12 comprises a metal plate of an approximately uniform thickness which is processed by pressing or the like. A front surface 20 of the edge 21 of the shell body 12 is arranged downwardly relative to the front surface 20 of a central portion of the shell body 12, and provided sideways via a second step portion 22 concaving downwardly. The edge 21 is formed with a through-hole 19*a* piercing the front surface 20 and a rear surface 20*a* in the upper-to-bottom direction along the edge 21. Meanwhile, a height of the first step portion 17 (a length M in a thickness direction between the front surface 16 of the inner edge 15 and the surface 16 of a central portion of the edge frame 11) is taller (larger) than sum of a height of the second step portion 22 (a length N in the thickness direction between the front surface 20 of the edge 21 and the surface 20 of the central portion of the shell body 12) and a thickness P of the shell body 12.

Moreover, the joining member 14 is provided so as to envelop the inner edge 15 and the edges 21, while it is arranged circularly along the inner edge 15 and the edge 21. A front surface 23 of the joining member 14 is provided in the same plane as the front surface 16 of the edge frame 11 and the front surface 20 of the shell body 12. A rear surface 23*a* thereof is provided so as to cover a bottom portion of the inner edge 15. Both side surfaces 24 thereof are provided so as to cover the first and second step portions 17, 22, respectively. In the joining member 14, the inner edge 15 and the edge 21 are laid on top of another with a clearance X so that the first and second through-holes 19, 19*a* are arranged to be equiaxial relative to each other. A resin is filled into the first and second through-holes 19, 19*a* and the clearance X. This filled resin is hardened. Meanwhile, the first and second through-holes 19, 19*a* may not be arranged to be equiaxial completely relative to each other, but the first and second through-holes 19, 19 may be partially arranged equiaxially, such that a portion of the second through-hole 19*a* may be arranged equiaxially relative to the first through-hole 19.

Examples of the sizes of the length M, etc. are the followings: the lengths M and N are 2 mm and 0.8 mm; a thickness of the edge frame 11 is 1.0 mm; the thickness P of the shell body 12 is 0.8 mm; lengths of the inner and outer edges 15, 21 are 6 mm and 5 mm; diameters of the through-holes 19, 19*a* are 3 mm; the clearance X between the inner edge 15 and the edge 21 is 0.4 mm; a clearance between the inner edge 15 and the rear surface 23*a* is 1.0 mm; and a clearance between the edge 21 and the front surface 23 is 0.8 mm. Each size may vary depending on a size of the entire head, but approximately plus minus 50% of changes in each size may be acceptable.

Meanwhile, an example of the resin of the joint member 14 is fiber-reinforced-plastic formed by infiltrating reinforced fiber with matrix resin. As examples of the reinforced fiber, carbon fiber, glass fiber, and aramid fiber can be considered. As examples of the matrix resin, epoxy resin, unsaturated polyester resin and vinyl ester resin can be considered. Further, as an example of the epoxy resin, polybutylene terephthalate can be considered. As a character of the matrix resin, less than or equal to 0.1% of water absorption coefficient is preferable (at 23° C., in water for 14 hours). Meanwhile, the resin of the joint member 14 may be heat-resistance epoxy resin or polyamid resin, while heat-resistance epoxy resin or polyamid resin may be used as single or fiber-reinforced resin.

Next, a method for forming the golf club according to this embodiment will now be explained in detail. First, the edge frame 11 is placed on a cavity-forming concaved portion 26 of a die 25. Next, the shell body 12 is placed on the cavity-forming concaved portion 26 so that the edge 21 and the inner edge 15 are laid on top of another. Then, the die 25 is closed with the other die 27 so that a cavity-forming convex portion 28 of the other die 27 presses the edge frame 11 and the shell body 12. Accordingly, the edge frame 11 and the shell body 12 are inserted in the dies 25, 27. Meanwhile, when the dies 25, 27 are closed, a cavity 29 for the joint portion 14 is formed on a portion where the inner edge 15 and the edge 21 are laid on top of another. A plurality of paths 30 for molten resin are connected to the cavity 29. The plurality of paths 30 are provided on the dies 25, 27 so that one ends thereof oppose the first and second through-holes 19, 19*a*.

Figure 4:
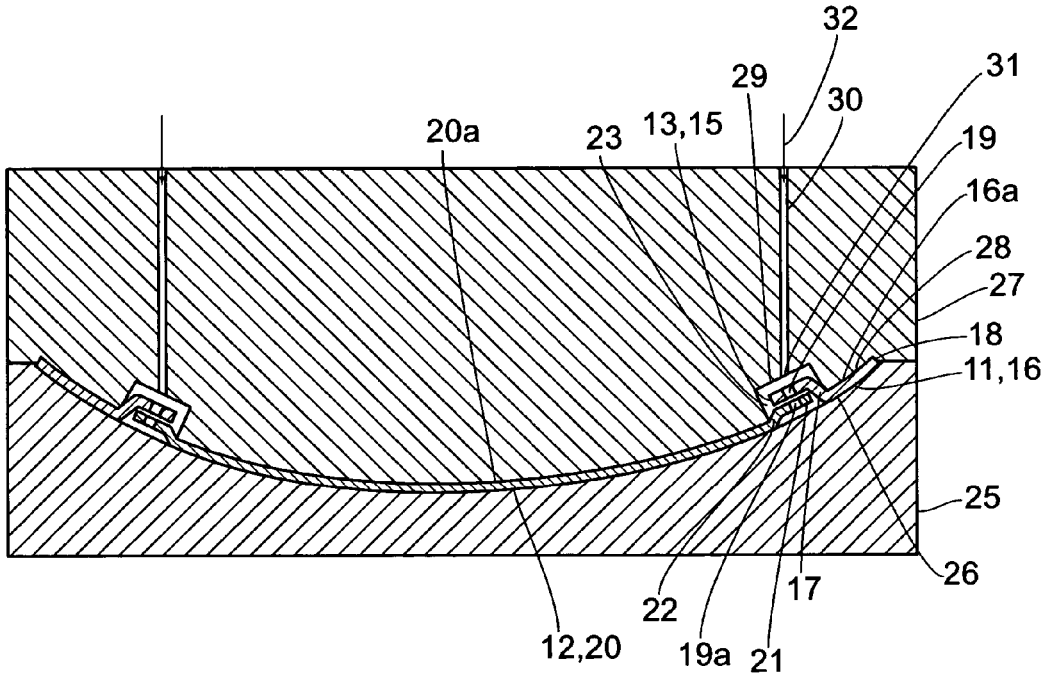
FIG. 4 is a cross sectional view showing molds for forming the golf club head according to the preferred embodiment.

Next, as illustrated by an arrow 32 in FIG. 4, a molten resin is filled in the plurality of paths 30 under a predetermined pressure. In this embodiment, the molten resin is subjected to injection molding via the plurality of paths 30. Accordingly, the molten resin is filled in the cavity 29 in a condition under molding pressure and envelops the inner and outer edges 15, 21 by casting manner, while it is also filled in the through-holes 19, 19*a* and the clearance X via the through-holes 19, 19*a*. After the molten resin becomes solidified, the dies 25, 27 are opened. Then, the partial crown portion member 10, in which the edge frame 11 and the shell body 12 are joined with each other via the joining member 14, is removed. The edge 18 of the partial crown portion member 10 is welded to the partial face portion member 6, the partial sole-peripheral side surface portion member 8 or the like in order to form the head 2.

As described above, according to this embodiment, the partial crown portion member 10 comprises: the edge frame 11 made from metal; the shell body 12 made from metal and provided inwardly of the edge frame 11; the joining member 14 made from resin and provided in between the inner edge 15 of the edge frame 11 and the edge 21 of the shell body 12 so as to envelop the inner edge 15 and the edge 21 by casting manner. Since the inner edge 15 and the edge 21 are enveloped by casting manner, the edge frame 11 and the shell body 12 made from different kinds of metals can be strongly joined.

Moreover, according to this embodiment, the inner edge 15 of the edge frame 11 and the edge 21 of the shell body 12 are laid on top of another, the first through-hole 19 allowing the front and rear surfaces 16, 16*a* to be pierced is provided on the inner edge 15, the second through-hole 19*a* allowing the front and rear surfaces 20, 21*a* to be pierced is provided on the edge 21. The joining member 14 envelops the portion where the inner edge 15 and the edge 21 are laid on top of another by casting manner, while it is filled in the first and second through-holes 19, 19*a*. Since the joining member 14 (resin) is filled in the through-holes 19, 19*a*, large retaining force can be obtained.

Further, according to a manufacturing processes of the partial crown portion member 10, after the edge frame 11 and the shell body 12 are inserted in the dies 25, 27, the molten resin is filled in between the inner edge 15 of the edge frame 11 and the edge 21 of the shell body 12 upon closing the dies 25, 27. The molten resin envelops the inner edge 15 and the edge 21 by casting manner so as to join the inner edge 15 and the edge 21. Due to a pressure for filling the molten resin, great adhesion of the molten resin, the inner edge 15 and the edge 21 can be obtained, and thus the inner edge 15 and the edge 21 can be strongly joined.

Still further, when inserting, the inner edge 15 and the edge 21 are laid on top of another so that the first and second through-holes 19, 19*a* are arranged approximately equiaxially relative to each other. Accordingly, the joint member 14 is filled in the first and second through-holes 19, 19*a* while equiaxially adhering, and thus large retaining force can be obtained. Moreover, the molten resin is evenly filled in the cavity 29 via the first and second through-holes 19, 19*a* arranged approximately equiaxially relative to each other. Therefore, easy-flowing of the molten resin can be ensured, and thus the molten resin can be sufficiently filled.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention.

For example, the present invention can be applied to not only the wood type golf club, but also the other types thereof, such as an iron type golf club. Moreover, whilst the present invention is especially applied to the partial crown portion member, but it may be applied to the partial face portion member or the partial sole-peripheral side surface portion member. Further, the head may employ a structure that filler such as a foamed material is filled therein. Still further, according to the above-described preferred embodiment, the inner edge 15 of the edge frame 11 is arranged downwardly relative to the edge 21 of the shell body 12, but it may be arrange upwardly relative to the edge 21. In this case, a rear surface of a joint surface of the resin is provided downward of the outer edge 21.

What is claimed is:

1. A golf club comprising:

a golf club head formed by a shell member so as to be hollow; and a shaft connected to said golf club head, wherein said shell member comprises:

a frame member made from a metallic material;

a shell body made from a material, said material having smaller specific gravity than the material of said frame member; and a joint member made from resin, said joint member being provided in between an inner edge of said frame member and an edge of said shell body so as to envelop said inner edge of said frame member and said edge of said shell body by casting manner, wherein said inner edge of said frame member and said edge of said shell body are laid on top of another, wherein a first through-hole is provided on said inner edge of said frame member so as to pierce a front surface of said inner edge to a rear surface thereof, wherein a second through-hole is provided on said edge of said shell body so as to pierce a front surface of said edge to a rear surface thereof, and wherein said joint member envelops a portion where said inner edge of said frame member and said edge of said shell body are laid on top of another, while said joint member being filled in said first through-hole and said second through-hole.

2. The golf club according to claim 1, wherein said first through-hole and said second through-hole are arranged equiaxially relative to each other.

3. A method for forming a golf club, the golf club comprising a golf club head and a shaft connected to the golf club head, the golf club head being formed by a plurality of partial shell members so as to be hollow, at least one of the partial shell members including a frame member made from a metallic material and a shell body made from metal, the shell body being provided inwardly of the frame member, the method comprising the steps of: inserting the frame member into a die; inserting the shell body into an inside of the frame member in said die; closing said die with an other die; filling a molten resin in between an inner edge of the frame member and an edge of the shell body; and enveloping the inner edge of the frame member and the edge of the shell body with the molten resin by casting manner so as to join the inner edge of the frame member and the edge of the shell body.

4. The method for forming a golf club according to claim 3, further comprising the steps of: forming a first through-hole on the inner edge of the frame member, the first through-hole piercing front and rear surfaces thereof; forming a second through-hole on the edge of the shell body, the second through-hole piercing front and rear surfaces thereof; allowing the inner edge of the frame member and the edge of the shell body to be laid on top of another upon inserting the frame member and the shell body into said dies; and arranging the first through-hole and the second through-hole equiaxially relative to each other upon inserting the frame member and the shell body into said dies.

* * * * *